US006581753B1

(12) United States Patent
Brewster et al.

(10) Patent No.: US 6,581,753 B1
(45) Date of Patent: Jun. 24, 2003

(54) TRANSPORT APPARATUS

(75) Inventors: Martin Brewster, High Wycombe (GB); Keith Arthur Bromwich, Watford (GB); John Cracknell, West Maidenhead (GB); Paul Edgley, Portsmouth, NH (US); David Thomas Hazell, Hillingdon (GB); Mehmet Oktay Kaya, Berkshire (GB); John Joseph O'Brien, High Wycombe (GB); Ian Ralph, Binfield (GB); Gary Frank Rogers, Yiewsley (GB); Kathryn Elaine Skipp, Windsor (GB); Andrew Malcolm Smart, Caversham (GB)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/363,275

(22) Filed: Jul. 28, 1999

(Under 37 CFR 1.47)

(30) Foreign Application Priority Data

Jul. 28, 1998 (GB) ..... 9816426

(51) Int. Cl.[7] ..... B65G 15/44; B65G 49/00

(52) U.S. Cl. ..... 198/470.1; 198/493; 198/644; 198/688.1; 198/836.2; 198/836.3

(58) Field of Search ..... 198/493, 470.1, 198/644, 688.1, 836.2, 836.3; 270/52.26, 52.29

(56) References Cited

U.S. PATENT DOCUMENTS

| | | | | | |
|---|---|---|---|---|---|
| 3,317,026 | A | * | 5/1967 | Zugel et al. | 198/341.04 |
| 3,591,165 | A | * | 7/1971 | McCahon et al. | 270/52.29 |
| 4,641,825 | A | * | 2/1987 | Mowry et al. | 270/53 |
| 4,721,296 | A | * | 1/1988 | Mowry | 198/644 |
| 4,770,284 | A | * | 9/1988 | Boss | 198/339.1 |
| 4,867,433 | A | | 9/1989 | Wells et al. | |
| 4,898,373 | A | * | 2/1990 | Newsome | 270/58 |
| 5,622,268 | A | * | 4/1997 | Conner et al. | 209/603 |
| 5,678,813 | A | * | 10/1997 | Osako et al. | 270/52.29 |
| 6,059,093 | A | * | 5/2000 | Merkli | 198/690.2 |
| 6,082,724 | A | * | 7/2000 | Kahlig et al. | 270/52.14 |
| 6,095,740 | A | * | 8/2000 | Hollenstein et al. | 270/52.26 |

FOREIGN PATENT DOCUMENTS

| | | | |
|---|---|---|---|
| DE | 36 02 319 A1 | * | 9/1986 |
| EP | 0 329 296 B1 | | 8/1989 |
| GB | 419 828 | | 11/1934 |
| WO | WO 94/21544 | * | 9/1994 |

* cited by examiner

*Primary Examiner*—Christopher P. Ellis
*Assistant Examiner*—Mark A. Deuble
(74) *Attorney, Agent, or Firm*—Laurence A. Greenberg; Werner H. Stemer; Gregory L. Mayback

(57) ABSTRACT

An apparatus for transporting a bundle of signatures moving continuously on a saddle chain to a working station includes an indexing chain moving with variable speed, and a clamping unit for keeping the bundle of signatures at a predetermined position on the indexing chain; a method of operating the apparatus; and a saddle binding machine incorporating the apparatus.

18 Claims, 8 Drawing Sheets

TRANSPORT APPARATUS

BACKGROUND OF THE INVENTION

Field of the Invention

The invention relates to transport apparatus particularly for transporting signatures from a continuously moving saddle chain of a saddle binding machine to a working station.

For the production of bound printed products, such as books, periodicals, magazines, and so forth, transport and gathering devices are well known. After collating single sheets or signatures on a gathering device, the collated bundles have to be fed by a transport device to further processing stations such as a trimming or stitching station.

A known transport device for feeding a bundle of collated signatures, a so-called book, to a further working station uses a shuttle assembly to move the bundle of signatures to a stitching station. The shuttle assembly grips the bundle and moves it to the stitching station where it is released. Then, the shuttle mechanism returns to grip the next succeeding bundle of signatures. When the shuttle mechanism engages the next bundle, it also engages the previously moved bundle of signatures located at the stitching station and moves the signatures, which in the meantime have been stitched, to a delivery station, while the next bundle is moved to the stitching station. A transfer device and a stitching machine of this general construction is known from U.S. Pat. No. 3,317,026. The existing systems used on many saddle stitchers use a so-called reciprocating gripper system. It comprises a row of grippers which, when closed, press against the outside of the book. These grippers are connected to a "backup" bar on the inside of the book, so that one half of the book is trapped between the grippers and this "backup" bar. The grippers open, in order to release the book at the stitching station and move back in their open condition. The grippers close on the continuously moving book on the saddle chain when they start to move forward again. In this way, they accelerate the books away from the conveyer chain and stop them at the stitching position. The whole gripper and backup assembly is supported on a linear slide and driven backward and forward by a crank mechanism.

This system, however, comprises a relatively large reciprocating mass which requires heavy support frames and a lubricated slide system. When the assembly is driven from a crank, velocities cannot easily be optimized due to the fact that a crank is only capable of simple harmonic motions. Finally, as the gripper and backup bar assembly can only contact the inner half of the book, the higher speed outside of the book is uncontrolled and this tends to cause the spine of the book to move off the saddle apex during quick. deceleration resulting in off-center stitching.

SUMMARY OF THE INVENTION

It is therefore an object of the invention to provide a new and improved method of transporting and transport apparatus, especially for transporting signatures, from a continuously moving chain to a working station.

With the foregoing and other objects in view, there is provided, in accordance with one aspect of the invention, an apparatus for transporting a bundle of signatures moving continuously on a saddle chain to a working station, comprising an indexing chain moving with variable speed, and a clamping unit for keeping the bundle of signatures at a predetermined position on the indexing chain.

In accordance with another feature of the invention, the indexing chain succeeds the saddle chain.

In accordance with a further feature of the invention, the clamping unit for keeping the bundle of signatures at a predetermined position includes a gripper element mounted on the indexing chain.

In accordance with an added feature of the invention, the apparatus includes a linear cam.

In accordance with an additional feature of the invention, the cam is operatively engageable with the gripper elements for opening and closing the gripper elements.

In accordance with yet another feature of the invention, the clamping unit for keeping the signatures at a predetermined position includes a belt for keeping the bundle of signatures in close contact with the indexing chain, the belt being disposed to at least one side of the indexing chain.

In accordance with yet a further feature of the invention, the clamping unit for keeping the bundle of signatures at a predetermined position includes rollers for keeping the signatures in close contact with the indexing chain at least on one side of the indexing chain.

In accordance with yet an added feature of the invention, the clamping unit for keeping the bundle of signatures at a predetermined position includes at least one blowing device for blowing air to the bundle of signatures moving on the indexing chain, the at least one blowing device being located on at least one side of the indexing chain.

In accordance with yet an additional feature of the invention, the blowing device includes a nozzle.

In accordance with still another feature of the invention, the clamping unit for keeping the bundle of signatures at predetermined positions comprises feeder pins.

In accordance with another aspect of the invention, there is provided a method for transporting a bundle of signatures moving continuously on a saddle chain to a working station, which comprises the steps of feeding a bundle of signatures with continuous speed to a transfer point, transferring the bundle of signatures from the continuously moving saddle chain to an indexing chain moving with variable speed, acting upon the bundle of signatures in order to keep the bundle of signatures in a definite position on the indexing chain, and moving the bundle of signatures on the indexing chain with a variable velocity profile to the working station.

In accordance with a further mode, the method of the invention includes the step of acting upon the bundle of signatures by a clamping unit for keeping the bundle of signatures at a predetermined position whereat the clamping unit moves with substantially the same velocity profile as the indexing chain.

In accordance with an added mode, the method includes performing the step of acting upon the bundle of signatures by a clamping unit blowing air onto the bundle of signatures, the clamping unit being disposed in a stationary manner at a side of the indexing chain.

In accordance with an additional mode, the method of the invention includes, during the transfer of the bundle of signatures from the saddle chain to the indexing chain, maintaining the velocity of the indexing chain substantially the same as the velocity of the saddle chain.

In accordance with a concomitant aspect of the invention, there is provided a saddle binding machine having a signature conveyor for conveying and gathering a plurality of signatures, comprising a transport apparatus having at least one of the foregoing features.

The invention of the instant application is thus especially directed to transport apparatus for transporting a bundle of moving signatures from a first moving chain, a so-called saddle chain, to a working station. When a number of gathered signatures, hanging upon one another on the continuously driven saddle chain, reach the point at which this bundle of signatures is to be transferred to the working station, the transport apparatus transports this bundle from the continuously driven saddle chain to the working station. This transport apparatus succeeds the saddle chain and is driven independently from the saddle chain. It comprises a second moving chain, a so-called indexing chain, which is driven with a velocity profile having variable speed. Furthermore, the transport apparatus according to the invention preferably comprises a devikce for keeping the bundle of signatures at predetermined positions on the indexing chain. At the time of the transfer of a bundle of signatures from the continuously moving first chain, namely a saddle chain, to the second chain, namely an indexing chain, that has a velocity profile, the second or indexing chain moves with the same speed as the first or saddle chain. Just after the back or trailing edge of the bundle of signatures has passed the transfer point, a device for keeping the bundles of signatures at registered positions on the indexing chain acts upon the bundle of signatures and keeps acting thereon at least as long as the working step lasts. After that, the indexing chain speeds up according to a predetermined velocity profile, accelerates the bundle of signatures away from the continuously moving saddle chain and brings the bundle of signatures to a working station, e. g. a stitching station. Before the bundle reaches the working station, the indexing chain is decelerated and stops at a position whereat the further working step, e. g. stitching, is to be performed. After this working process has been finished, the indexing chain accelerates again and moves the bundle of signatures to a second working station or to a transfer position where the bundle of signatures is transferred to a final working station or to another transport device. During this whole procedure, the device for keeping the bundle of signatures at a predetermined position on the indexing chain acts upon the bundles of signatures. This keeps the bundles of signatures at registered positions on the indexing chain during the whole feeding and working process.

Combining a continuously moving first or saddle chain, on which the bundle is collated, with a second or indexing chain having a variable velocity profile and being arranged so as to succeed to the first continuously moving chain, makes it possible to accelerate the bundle of signatures away from the first continuously moving chain. Thereby, the velocity profile of the second chain can easily be adjusted to the required demands by driving and control equipment coupled to the second chain. The driving and control equipment drive the second chain and control the velocity profile thereof. The device for holding the bundle of signatures at a predetermined position on the second chain ensures a fixed and definite position of the bundles on the moving indexing chain during its movement, as well as during the working process at the working station. As a consequence, this allows high speed and high acceleration of the indexing chain, as well as high speed working at the working station.

Other features which are considered as characteristic for the invention are set forth in the appended claims.

Although the invention is illustrated and described herein as embodied in a transport apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
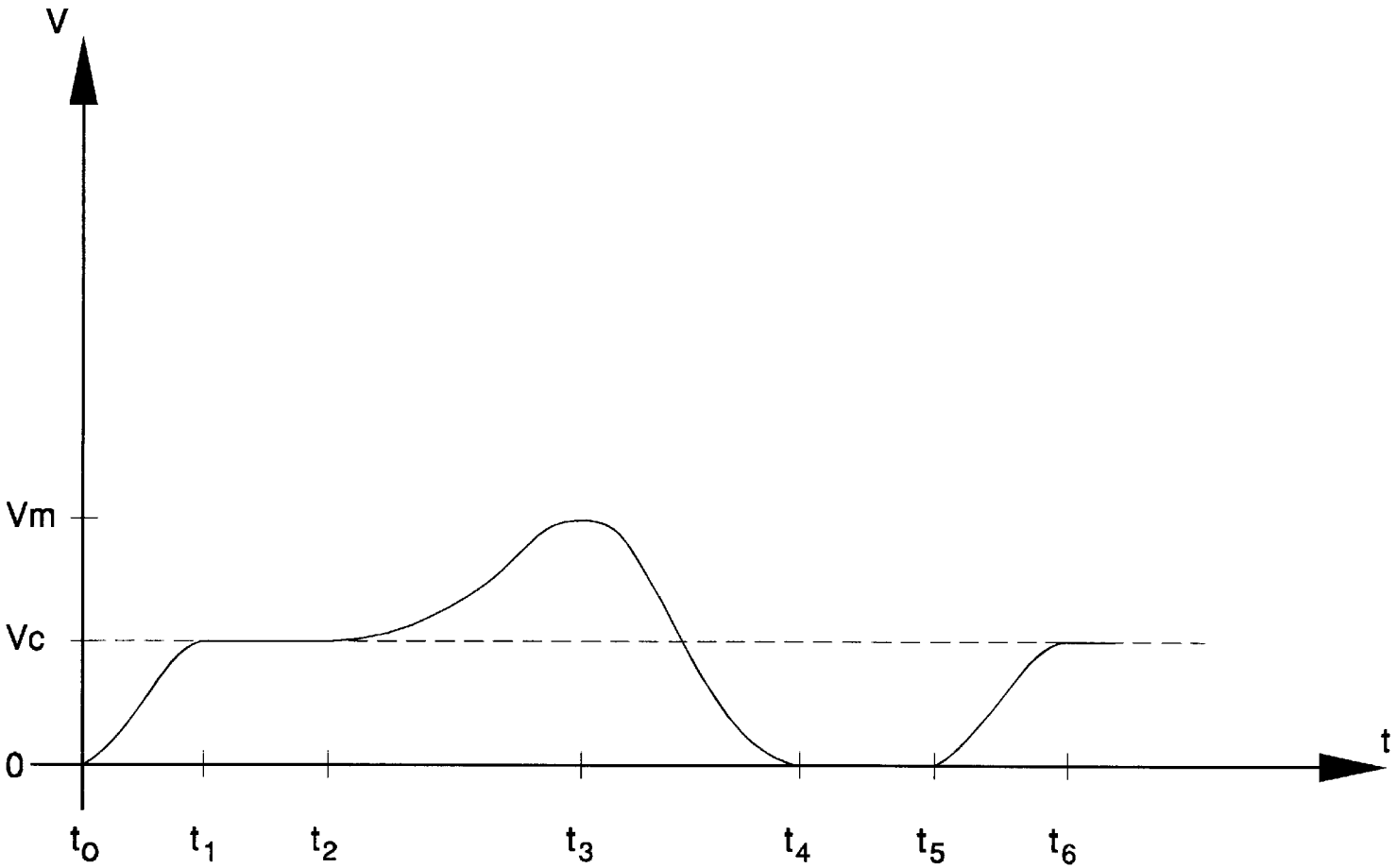
FIG. 1 is a plot diagram of a possible velocity profile of an indexing chain according to the invention.
Figure 2:
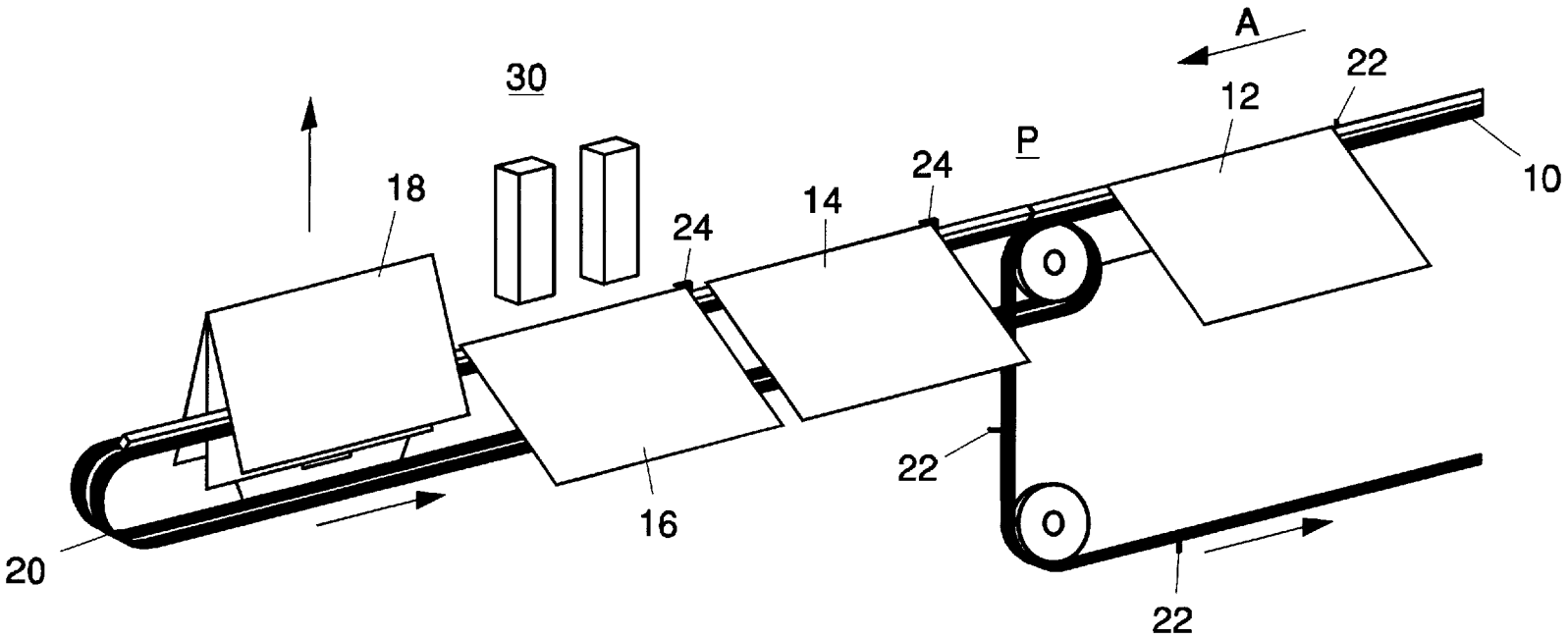
FIG. 2 is a fragmentary, diagrammatic side, end and top perspective view of transport apparatus according to the invention.

Referring now to the drawings and, first, particularly to FIG. 1 thereof, there is shown therein a possible velocity profile of the transport apparatus according to the invention that is diagrammatically illustrated in FIG. 2. The horizontal axis represents the time and the vertical axis the velocity, both in arbitrary units. A working period is defined by the time interval between $t_0$ and $t_5$. At time to, the velocity of the indexing chain 20 is zero and, at this instant, it starts to move and its velocity increases up to a value $v_c$ at $t_1$, where $v_c$ is the velocity of the continuously moving saddle chain 10. Within the time period between $t_1$ and $t_2$ a collated bundle of signatures 12 moving continuously on chain 10 enters the transfer point P (FIG. 2) where the bundle is transferred to the indexing chain 20 which at this time has the same velocity v as the saddle chain 10. At $t_2$ the rear or trailing edge of the bundle of signatures is downline from the transfer point P, and the indexing chain 20 accelerates up to $t_3$ to its maximum speed $v_m$. Within the time interval between $t_3$ and $t_4$ the indexing chain decelerates again and the bundle of signatures reaches a stitching station at time $t_4$ whereat the indexing chain stops. Within the time interval between $t_4$ and $t_5$ a working step, e. g. stitching, is done, and after this step has been finished, the bundle of signatures is accelerated away from the further working station at $t_5$, which corresponds to $t_0$ whereat the velocity profile starts again from its very beginning.

Referring now in greater detail to FIG. 2, a continuously moving first or saddle chain 10 is shown. On this saddle chain, a bundle of signatures 12 is continuously moving in the direction given by the arrow A where the trailing edge of the bundle 12 is pushed by a pusher finger 22 mounted on the saddle chain 10. The pusher finger 22 pushes the bundle 12 in the direction of the transfer point P where the saddle chain 10 moves downwardly together with the pusher finger 12. Therefore, the pusher finger 22 ceases acting upon the bundle 12 and is not driven anymore by the saddle chain 10.

The bundle of signatures 12 now has reached a position which is represented by the position of the bundle of signatures 14 and which lies immediately downline of the transfer point P. At this time, a clamping unit 24 for keeping the signatures 14 in a predetermined position on the indexing chain 20 begins to act upon the bundle of signatures 14 in a manner which will be described in greater detail hereinafter. The bundle of signatures 14 then are transported on the indexing chain 20 with the variable velocity of the indexing chain 20, while the clamping unit 24 keeps the bundle of signatures 14 at a predetermined position on the indexing chain 20 and does not release from the signatures 14. In this way, the bundle of signatures 14 is transferred to a stitching station 30, where they reach a position indicated by the position of the bundle 16. During a working process, e. g. the stitching process, the clamping unit 24 for keeping the signature at predetermined positions, preferably continues to act upon the signature. After stitching has been done, the bundle of signatures 14 is moved forward with the variable velocity profile of the indexing chain 20 to a position indicated by a bundle of signatures 18 where the bundle of signatures is transferred to another transport device for proceeding with further final working steps.

Figure 3:
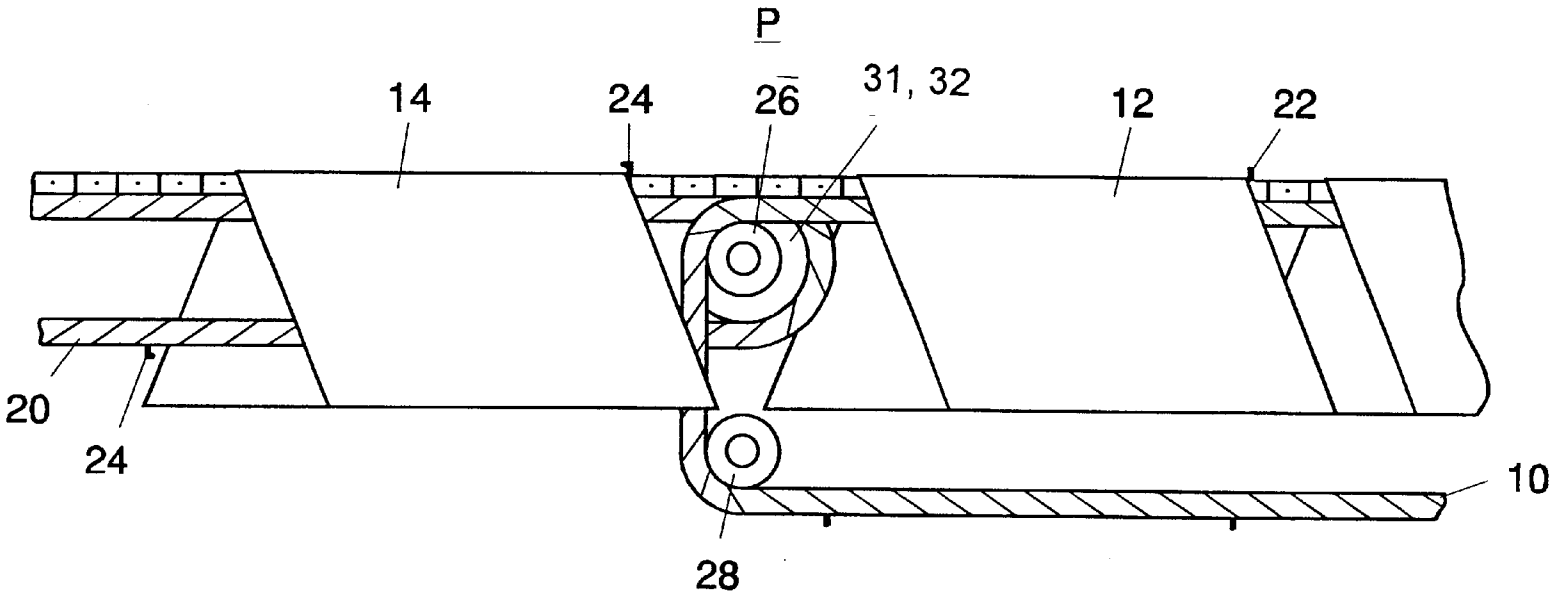
FIG. 3 is an enlarged fragmentary view of FIG. 2 depicting the region of transfer from a saddle chain to the indexing chain in one embodiment of the invention.

At the transfer point P shown in FIG. 3, a bundle of signatures 12, moving continuously on the first saddle chain 10, is transferred to a second saddle chain 20 having a variable velocity profile. The bundle of signatures 12 on the chain 10 is engaged with a pusher finger 22 acting upon the trailing edge of the bundle. As the pusher finger 22 is mounted on the chain 10, the bundle of signatures 12 is pushed forward with the same continuous velocity of chain 10, until chain 10 moves downwardly supported by rollers 26 and 28. At this time, the pusher finger 22 ceases to act upon the trailing edge of the bundle of signatures 12, and the bundle is transferred to the second chain 20 moving with a variable velocity profile. At the transfer point P, the chain 20 is supported by rollers 31, 32. Clamping units, such as the gripper element 24, are mounted on the variable moving chain 20 and act upon the trailing edge of the bundle of signatures and thereby clamp the bundle of signatures to fix them in a desired position on the variable moving chain 20. At the transfer point P, a bundle of signatures having a position corresponding to the position of the bundle 12 is moved forward with constant speed $v_c$. At the time, when the bundle 12 is transferred to the indexing chain 20, it preferably moves with the same speed $v_c$ as that of the chain 10. One of the gripper fingers 24 mounted on chain 20 then engages with the trailing edge of transferred bundle of signatures 12. It therefore does not stop moving forward at the transfer point and is transferred from the continuously moving saddle chain 10 to the indexing chain 20 with substantially the continuous speed $v_c$ of the continuously moving first chain 10. When the bundle of signatures 12 has passed the transfer point P and may for example have assumed a position given by the position of the bundle of signatures 14, the bundle of signatures 14 is accelerated away from the saddle chain 10 on the indexing chain 20 where the indexing chain 20 accelerates according to a velocity profile given in FIG. 1 by way of example.

Figure 4A:
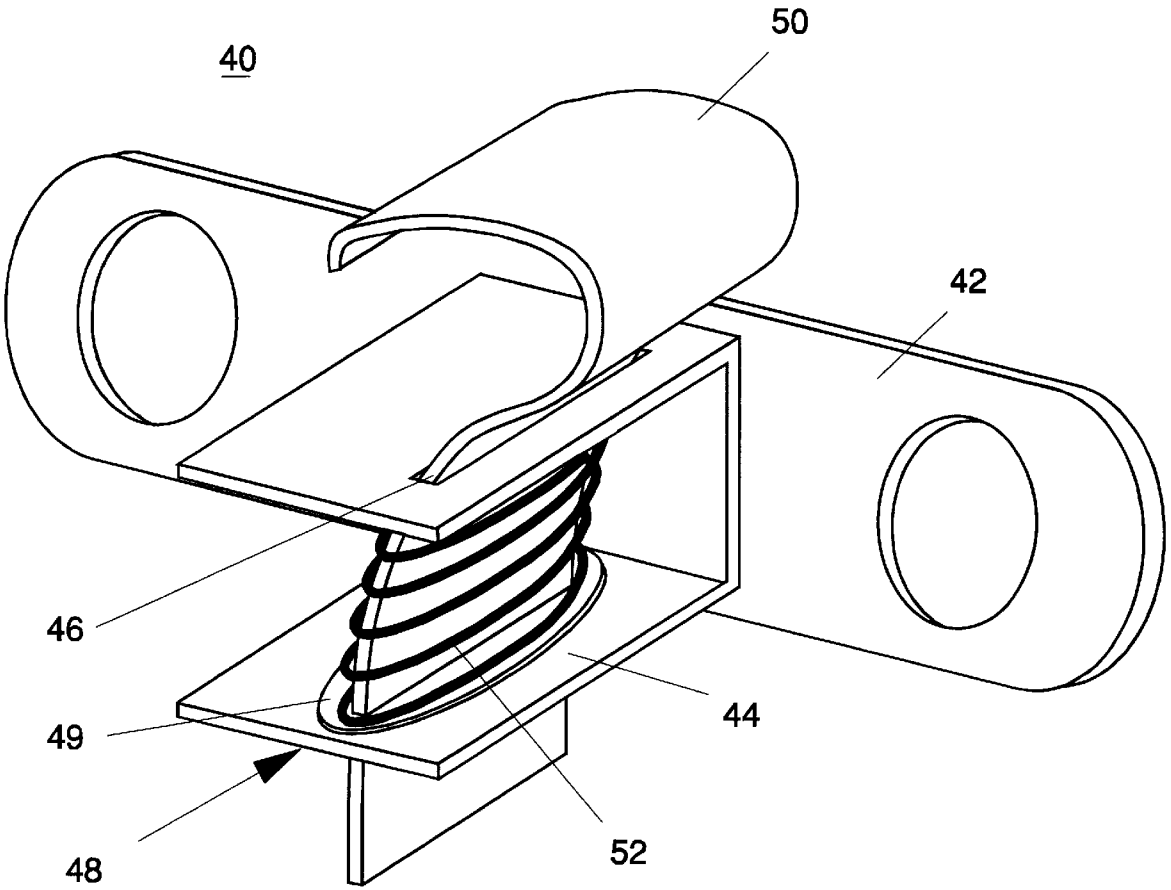
FIG. 4*a* is an end, side and top perspective view of a gripper element forming part of the invention.

Referring now to FIG. 4*a,* a gripper element 40 and an opening and closing mechanism for the gripper unit are shown. The clamping unit 24 (FIG. 2) mounted on the indexing chain 20 may be a gripper element 40 for gripping the signatures 14 and keeping them in a predetermined position on the indexing chain during the whole feeding process. The gripper element 40 comprises a side plate 42 for linking the gripper element 40 to the indexing chain 20. The side plate 42 is mounted on a U-shaped support 44 having an upper opening 46 and a lower opening 48 which is covered by a plate 49. A gripper hook 50 extending through the upper opening 46 and the lower opening 48 is coupled to a spring 52 acting upon the hook 50, in order to apply force to the hook 50 which is directed downwardly or more specifically in the direction towards the lower opening 48. In this position, the gripper element 40 is in so-called "closed" condition, in which a bundle of signatures can be gripped. This position can be changed to "open" by acting upon the hook 50, especially by acting upon the lower end of the hook 50 extending through the lower opening 48.

Figure 4B:
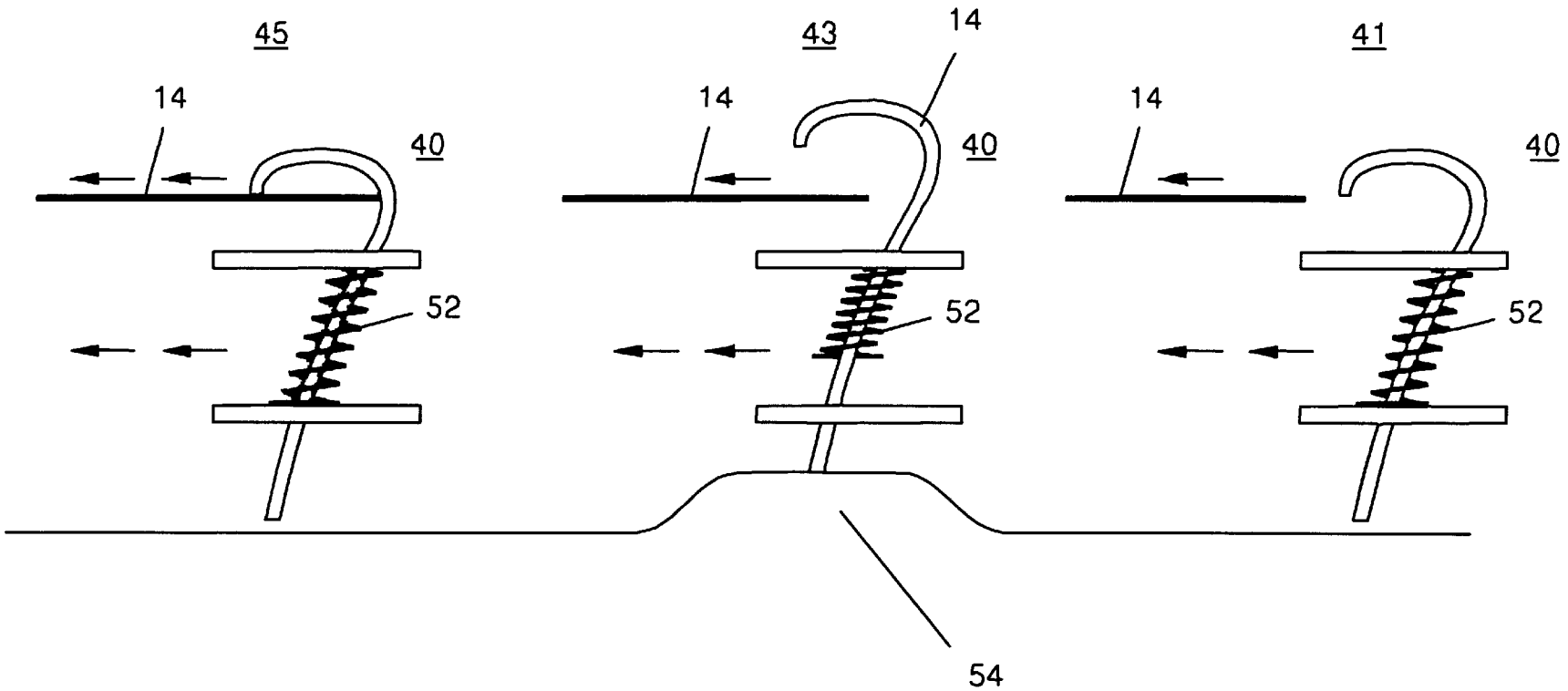
FIG. 4*b* is a fragmentary diagrammatic side elevational view of the region of transfer from the saddle chain to the indexing chain in one embodiment of the invention, wherein a gripper element as shown in FIG. 4*a* is used.

In FIG. 4*b,* three positions 41, 43 and 45 of a gripper element 40 mounted on a non-illustrated indexing chain are depicted. A bundle of signatures 14 having just passed the transfer point P and therefore being transferred to the indexing chain, lies just in front of the appearing gripper element 40 which, at this instant, is in the position 41 and moves slightly faster than the bundle of signatures 14. Upon further movement of the indexing chain 20, the gripper element 40 reaches the position 43 whereat a linear cam 54, which is preferably connected to the indexing chain 20, begins to act upon the lower end of the hook 50, which extends through the lower opening 48 of the support 44. As to the shape of the cam, the hook 50 is pushed upwardly and moves through the upper opening 46 and the lower opening 48 and comes into an open position in which the gripper element 40 is able to grip the bundle of signatures 14. At the same time, the spring 52 of the gripper element 40 in the position 43 is compressed and, as it is coupled to the hook 50 directly or via the plate 49, it applies a force upon the hook 50 downwardly. Because the bundle of signatures, which has been transferred from the saddle chain to the indexing chain with constant velocity $v_c$, is at this time not driven anymore, the gripper element 40 moves with a velocity which is slightly higher than the velocity of the bundle of signatures. Therefore, the distance between the gripper element 40 and the bundle of signatures 14 decreases until the gripper element 40 begins to act upon the trailing edge of the bundle 14.

According to the shape of the linear cam 54, the cam stops acting upon the lower end of the hook member 50 upon further movement of the gripping member 40. Simultaneously, the spring 52 relaxes and the hook 50 begins to move downwardly until it clamps the bundle of signatures 14 at the position 45. At this point, the bundle of signatures 14 and the gripper element 40 are in close contact and move with the same speed.

Using a linear cam coupled to the indexing chain and able to act upon clamping members 40 mounted on the indexing chain and moving with the velocity of the indexing chain, it is possible to open and close these clamping members, in order to grip the bundle of signatures 14 and to keep it in a definite position on the indexing chain during the whole transport and working process. In order to release the bundle of signatures, the same opening and closing mechanism as described hereinabove can be used when the bundle of signatures is to be transported away from the indexing chain.

Figure 5:
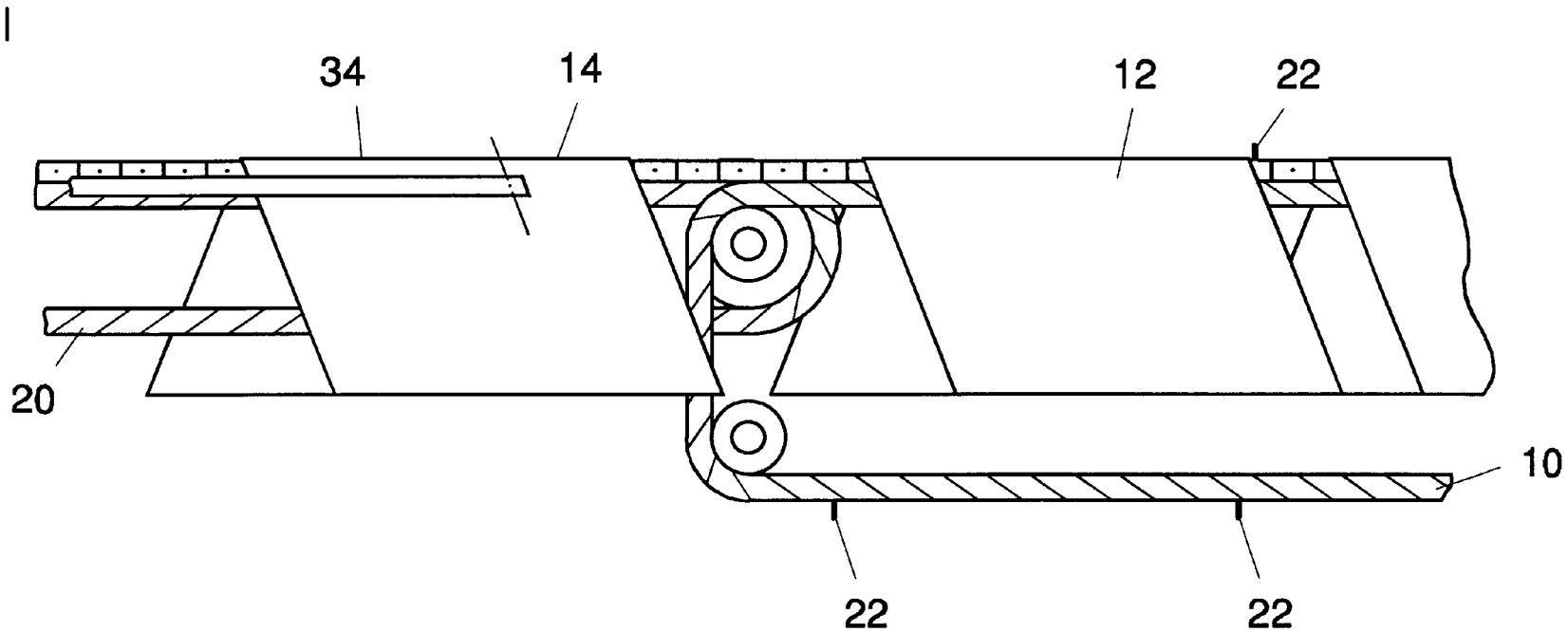
FIG. 5 is a fragmentary view like that of FIG. 3 depicting the region of transfer from the saddle chain to the indexing chain in an alternative embodiment of the invention.

In a further embodiment of the invention, the clamping units 24 for keeping the bundle of signatures at predetermined positions on the indexing chain 20 may be one or more belts 34, as shown in FIG. 5. Instead of arranging the gripper elements 40 on the indexing chain 20 as shown in FIGS. 3 and 4, the belt or belts 34 can be arranged aside the saddle chain 20 at a given distance from to the saddle chain, which makes it possible to clamp the bundle of signatures 14 between the belt or belts 34 and the saddle chain 20. Because the belt or belts 34 move with the same velocity profile as the indexing chain 20, a signature 14 clamped between the indexing chain 20 and the belt or belts 34 is transported with the velocity profile of the chain 20.

Figure 7:
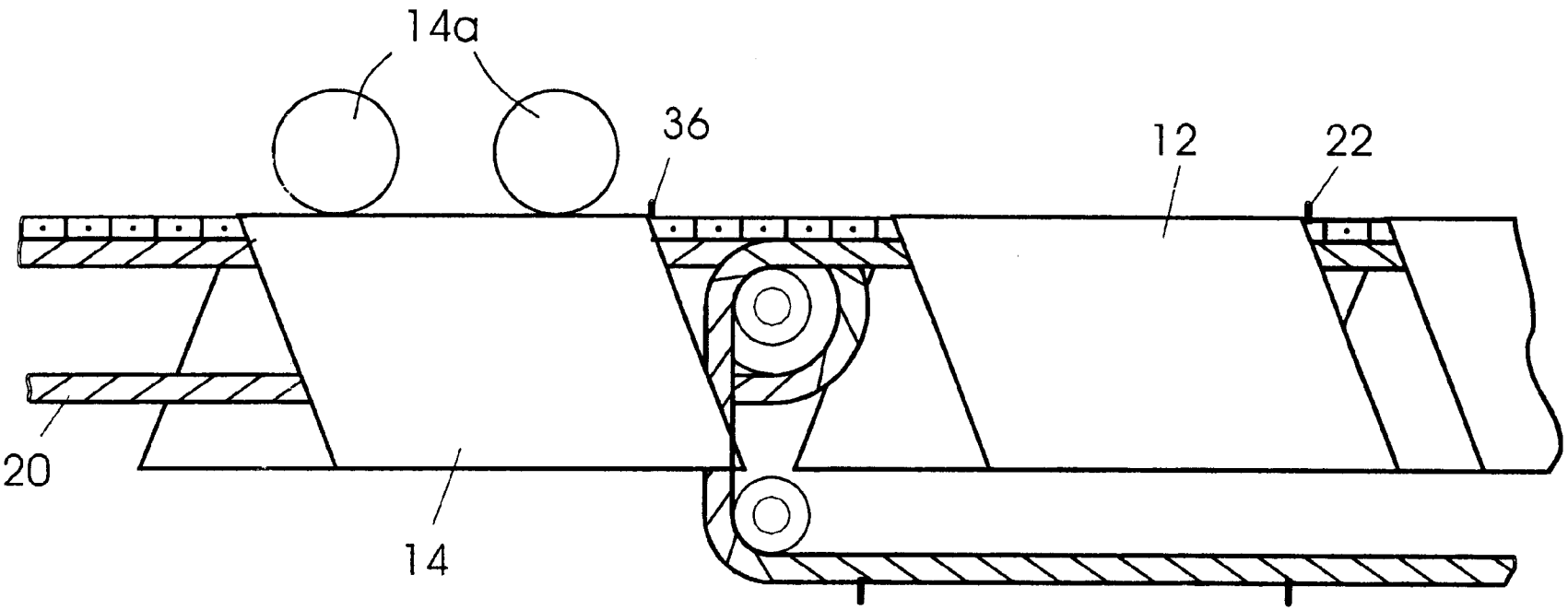
FIG. 7 is a view similar to that of FIG. 5, showing another embodiment of the invention.

As shown in FIG. 7, it may also be possible to use a plurality of rollers 14*a* arranged at least on one side of the saddle chain 20 and driven with the same velocity profile as chain 20. Both the belt or belts as well as the rollers, can be arranged either on one or both sides of the indexing chain and act upon the bundle of the signatures 14, in order to fix the bundle on the chain in a definite position during transport and the working process.

Figure 6:
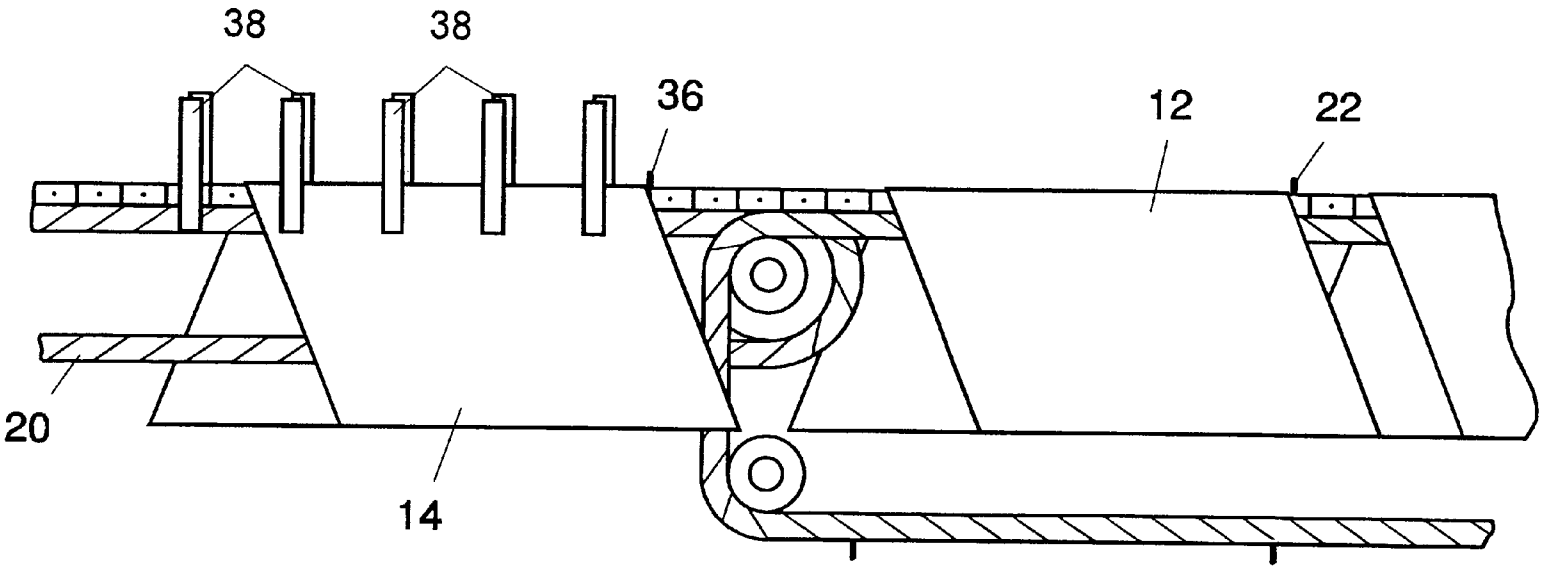
FIG. 6 is a view similar to that of FIG. 5, but showing a further alternative embodiment of the invention.

In a further embodiment of the invention shown in FIG. 6, the clamping units 24 for keeping the signatures at a predetermined position on the indexing chain 20 are arranged aside the saddle chain 20, and act upon the bundle of signatures 14 by blowing air at least on one side of the bundle of signatures. For this purpose, blowing devices 38 are mounted at least on one side of the indexing chain 20. These blowing devices may comprise single nozzles or air tubes having air nozzles for blowing air onto the bundle of signatures moving on the indexing chain 20. The air that is directed to the bundle of signatures 14 generates pressure on the bundle of signatures 14 so that the bundle of signatures is pressed against the chain 20 and is moved with a velocity profile of the chain 20, respectively. The spacing of the blowing devices is such that preferably a continuous air flow is directed to the moving bundle of signatures on the indexing chain.

In addition to the devices for keeping the signatures at a predetermined position shown in FIGS. 5 and 6, feeder pins 36 may be arranged on the indexing chain 20, in order to improve the contact of the bundle of signatures to the indexing chain 20 and to improve the transporting behavior.

Depending upon the signatures to be transported on the indexing chain 20, it may also be possible to use the feeder pins 36 mounted on the indexing chain 20 as the only device for keeping the bundle of signatures in close contact with the indexing chain or to use grippers 40 in addition to the belt or belts 34, the rollers or the blowing devices.

It will of course be understood that the invention of the instant application has been described hereinabove purely by way of example and that modifications of detail can be made within the scope of the invention.

We claim:

1. An apparatus for transporting a bundle of signatures to a working station, comprising:

an indexing chain moving according to a velocity profile with variable speed for transporting a bundle of signatures, the variable velocity profile including a stop; and a clamping unit for keeping the bundle of signatures at a predetermined position on said indexing chain.

2. The apparatus according to claim 1, including a continuously moving saddle chain preceding said indexing chain.

3. The apparatus according to claim 1, wherein said clamping unit for keeping the bundle of signatures at a predetermined position includes a gripper element mounted on said indexing chain.

4. The apparatus according to claim 3, wherein said clamping unit is operatively engageable with said gripper elements for opening and closing said gripper elements.

5. The apparatus according to claim 1, including a linear cam.

6. The apparatus according to claim 1, wherein said clamping unit for keeping the signatures at a predetermined position includes a belt for keeping the bundle of signatures in close contact with said indexing chain, said belt being disposed to at least one side of said indexing chain.

7. The apparatus according to claim 1, wherein said clamping unit for keeping the bundle of signatures at a predetermined position includes rollers for keeping the signatures in close contact with said indexing chain at least on one side of said indexing chain.

8. The apparatus according to claim 1, wherein said clamping unit for keeping the bundle of signatures at predetermined positions comprises feeder pins.

9. The apparatus according to claim 1, wherein said velocity profile of said chain includes a complete stop at a working station.

10. An apparatus for transporting a bundle of signatures to a working station, comprising:

an indexing chain moving with variable speed according to a periodic velocity profile during an operating mode for transporting a bundle of signatures; and a clamping unit for keeping the bundle of signatures at a predetermined position on said indexing chain.

11. A method for transporting a bundle of signatures, which comprises the steps of:

feeding a bundle of signatures with continuous speed to a transfer point;

transferring the bundle of signatures from the continuously moving saddle chain to an indexing chain;

acting upon the bundle of signatures in order to keep the bundle of signatures in a definite position on the indexing chain; and moving the bundle of signatures on the indexing chain with a variable velocity profile to a working station, the variable velocity profile including a stop.

12. The method according to claim 11, wherein the step of acting upon the bundle of signatures is done by a clamping unit for keeping the bundle of signatures at a predetermined position whereat the clamping unit moves with substantially the same velocity profile as the indexing chain.

13. The method according to claim 11, wherein the step of acting upon the bundle of signatures is performed by a clamping unit blowing air onto the bundle of signatures, the clamping unit being disposed in a stationary manner at a side of the indexing chain.

14. The method according to claim 11, which includes, during the transfer of the bundle of signatures from the saddle chain to the indexing chain, maintaining the velocity of the indexing chain substantially the same as the velocity of the saddle chain.

15. A saddle binding machine having a signature conveyor for conveying and gathering a plurality of signatures comprising a transport apparatus according to claim 1.

16. The method according to claim 11, wherein the step of moving the bundle of signatures on the indexing chain with a variable velocity profile includes a complete stop at the working station.

17. An apparatus for transporting a bundle of signatures to a working station, comprising:

an indexing chain moving according to a velocity profile with variable speed for transporting a bundle of signatures; and a clamping unit for keeping the bundle of signatures at a predetermined position on said indexing chain, said clamping unit including at least one blowing device for blowing air to the bundle of signatures moving on said indexing chain, said at least one blowing device being located on at least one side of said indexing chain.

18. The apparatus according to claim 17, wherein said blowing device includes a nozzle.

* * * * *